US006179929B1

(12) United States Patent
Gudini et al.

(10) Patent No.: US 6,179,929 B1
(45) Date of Patent: Jan. 30, 2001

(54) MOTORISED VEHICLE FOR CLEANING AND DEGASSING UNDERGROUND STORAGE TANKS

(75) Inventors: Maddalena Gudini, Coriano; Mario Pompeo Pivi, Rimini, both of (IT)

(73) Assignee: T. & A. S. A., San Marino (IT)

( * ) Notice: Under 35 U.S.C. 154(b), the term of this patent shall be extended for 0 days.

(21) Appl. No.: 09/171,381

(22) PCT Filed: Apr. 16, 1997

(86) PCT No.: PCT/IT97/00083

§ 371 Date: Nov. 10, 1998

§ 102(e) Date: Nov. 10, 1998

(87) PCT Pub. No.: WO97/38804

PCT Pub. Date: Oct. 23, 1997

(30) Foreign Application Priority Data

Apr. 16, 1996 (IT) ..... 96 A 000510

(51) Int. Cl.[7] ..... B08B 9/04

(52) U.S. Cl. ..... 134/18; 134/22.1; 134/113; 134/167 R; 134/168 R

(58) Field of Search ..... 134/113, 167 R, 134/168 R, 18, 22.1

(56) References Cited

U.S. PATENT DOCUMENTS

| | | | | |
|---|---|---|---|---|
| 4,770,711 | | 9/1988 | Deal, III et al. | 134/18 |
| 4,777,971 | * | 10/1988 | Tribout et al. | 134/167 R |
| 4,817,653 | | 4/1989 | Krajicek et al. | 134/168 R |
| 5,640,982 | * | 6/1997 | Landry et al. | 134/167 R |
| 5,740,821 | * | 4/1998 | Arnold | 134/113 |
| 5,884,642 | * | 3/1999 | Broadbent | 134/168 R |
| 5,944,036 | * | 8/1999 | Allen | 134/167 R |

FOREIGN PATENT DOCUMENTS

| | | |
|---|---|---|
| 5-131381 | 5/1993 | (JP) . |
| 5-170282 | 7/1993 | (JP) . |
| 5-200373 | 8/1993 | (JP) . |

OTHER PUBLICATIONS

International Search Report for PCT/IT97/00083, Aug. 22, 1997.

* cited by examiner

*Primary Examiner*—Randy Gulakowski
*Assistant Examiner*—Saeed Chaudhry
(74) *Attorney, Agent, or Firm*—Oppenheimer, Wolff & Donnelly LLP

(57) ABSTRACT

A device for cleaning and degassing underground storage tanks is constituted by an entirely pneumatically or hydraulically powered motorized vehicle, which can be placed internally of a tank to be cleaned and be moved around inside the tank itself, for example by means of tracked wheels driven by respective pneumatic or hydraulic motors. Said motorized vehicle may be provided with a first series of nozzles, frontally arranged with respect to the advancement direction of the vehicle, which nozzles emit water at high pressure with the aim of breaking up and suspending in the water the deposits collected in the tank; the vehicle is also provided with a suction mouth arranged anteriorly of the first series of nozzles, by means of which mouth the water-suspended deposits are aspirated and removed from the tank.

11 Claims, 2 Drawing Sheets

MOTORISED VEHICLE FOR CLEANING AND DEGASSING UNDERGROUND STORAGE TANKS

TECHNICAL FIELD

The present invention relates to a device for cleaning and degassing underground storage tanks.

More in particular, the present invention relates to a motorised vehicle, powered pneumatically or hydraulically, for carrying out cleaning and degassing operations of underground tanks, particularly tanks for fuel storage, in conditions of maximum security.

The invention is principally intended for use in the oil industry field.

BACKGROUND ART

Cleaning and degassing operations in underground fuel storage tanks are traditionally carried out by first emptying the tank, using a suction pump, and then lowering an operative into the tank itself, who, using special tools guaranteed not to produce any sparks which might cause an explosion, then scours the internal part of the tank; said operative also being provided with a suction mouth, guided by him, for removing by aspiration the sludge gathered at the bottom of the tank.

This operation is in reality extremely dangerous, due to the presence of inflammable vapours inside the tank, liable to cause explosions and possibly the death of the operator.

Further, the cleaning operation carried out by the operator requires great use of cleaning water, which also has to be collected up and suitably dispersed.

Instead of employing an operator to be introduced inside of a fuel storage tank, JP-A-4,038,496 discloses a travelling truck which can be inserted into a container to be cleaned.

Said truck is able to clean the side walls, the ceiling and the floor of the container by means of water injected from suitable nozzles, at the end of the cleaning operation said water being received by side covers positioned on both sides of the truck and then collected in the corner to be sucked by a suction pipe.

Furthermore, U.S. Pat. No. 4,770,711 discloses a portable hydraulic apparatus for cleaning the hydrocarbon contaminated sludge deposit of an oil storage tank by means of a fluidizing agent.

Said apparatus comprises a frame, having a central portion and first and second end portions, and a couple of independently movable endless chain belts suitable to move the frame within the oil storage tank; the fluidizing agent is discharged into selected portions of the sludge deposit so as to form a pool of sludge and fluidizing agent.

Then, a suction pump positioned on the central portion of the frame draws up said pool. Moreover, a plurality of nozzles is disposed adjacent the first end portion of the frame and is connected with the suction pump so as to provide pressurized agitation and discharging of the pool into a second portion of the sludge deposit adjacent said first end portion of the frame so as to dislodge and also aid in liquifying the second portion of the sludge deposit.

Document JP-A-3,137,955 describes a small robot to be used in hazardous environments wherein it is immersed in liquid and motioned by means of main endless tracks on both side of a main shaft and of auxiliary endless tracks at the front and rear ends of the main shaft via a rotative auxiliary chassis.

Moreover, document U.S. Pat. No. 4,817,653 discloses a water washing robot which comprises a frame provided with water pumps means, robot articulations means disconnectably mounted on the frame and nozzled articulatable wash water jetting means disconnectably mountable on the frame.

The robot is transported, in unassembled form, inside of oil storage tanks and assembled therein to be used in cleaning operations. One operator is required inside the storage tank to control the robot moving and working phases.

DESCRIPTION OF THE INVENTION

The present invention obviates the drawbacks and disadvantages typical of the prior art and provides a device for cleaning and degassing underground storage tanks which allows effective and careful tank cleaning operations to be carried out in conditions of total security for the operators, as well as considerably reducing the environmental impact of the cleaning activity.

This is obtained by means of a device having the features described in the main claim.

The dependent claims describe particularly advantageous forms of embodiment of the invention.

The device for cleaning and degassing underground storage tanks according to the present invention is constituted by an entirely pneumatically or hydraulically powered motorised vehicle, which can be placed internally of the tank to be cleaned and be moved around inside the tank itself, for example, by means of tracked wheels driven by respective pneumatic or hydraulic motors.

The motorised vehicle according to the invention is provided with a first series of nozzles, frontally arranged with respect to the advancement direction of the vehicle, which nozzles emit water at high pressure with the aim of breaking up and suspending in the water the deposits collected in the tank; the vehicle is also provided with a suction mouth arranged anteriorly of the first series of nozzles, by means of which mouth the water-suspended deposits are aspirated and removed from the tank.

The motorised vehicle is further provided with a second series of nozzles, arranged on one or more rotating heads, which nozzles emit water at high pressure along the whole internal surface of the tank. This has the double aim of removing any encrustation from the wall of the tank and of performing the final wash of the tank itself.

According to a particularly advantageous form of embodiment of the invention, the motorised vehicle is further provided with a support for a television camera and a light, both of which are obviously totally electrically sealed from the contents of the tank.

The television camera thus enables the motorised vehicle to be moved into zones where there is a particular need for cleaning, thereby improving the efficiency of the cleaning and degassing operation.

DESCRIPTION OP THE DRAWINGS

Other features and advantages of the invention will become apparent during the following description, provided in the form of a non-limiting example and with the aid of the accompanying figures of the drawings, in which.

DESCRIPTION OF A FORM OF EMBODIMENT

The cleaning and degassing process for underground fuel storage tanks, using a motorised vehicle according to the present invention, can be subdivided into four fundamental phases.

In a first of these, a "filming" substance is used, having the property of forming a hydrocarbon-proof film so that a continual emission of explosive gases is blocked; then a flexible plastic pipe is inserted, provided with a special conveyor positioned at the top of the pipe; the pipe being connected to a suction pump.

This pipe is introduced into the fuel storage tank through the manhole thereof and is immediately activated.

In this way the majority of the sandy or muddy deposit is aspirated from the central part of the fuel storage tank bottom.

Following this, the pipe is withdrawn, and the motorised vehicle 10 of the invention, which will be more fully described hereinbelow, is introduced into the tank.

The vehicle 10, activated either pneumatically or hydraulically from a control panel situated externally of the tank, can be moved both longitudinally and to a certain extent transversally along the internal wall of the tank.

The vehicle 10, externally connected to a mobile truck-mounted tank 12 exhibiting separate compartments, is provided with a series of frontal nozzles through which water is emitted at a pressure which is sufficiently high to break up and suspend in the water the deposits which were not removed during the first phase.

The material thus raised is aspirated by a suction mouth with which the vehicle 10 is equipped.

In the third phase, the supply of water to the frontal nozzles is suspended and instead water is directed at high pressure (about 200 bars, for example) through the nozzles mounted on a rotating head arranged on the vehicle 10.

During this phase the filming product can be dispensed, in various percentages, through the series of nozzles.

Figure 1:
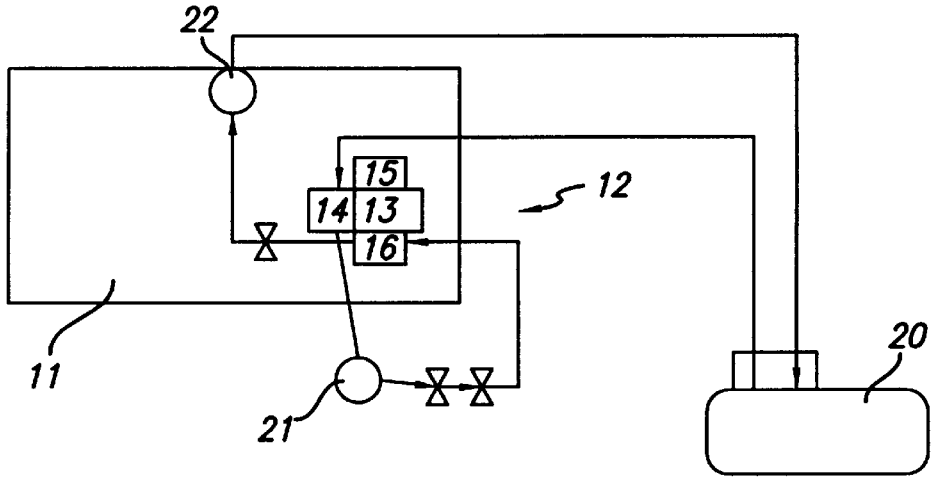
FIG. 1 shows a schematic representation of a work phase of fuel storage tank cleaning and degassing, carried out by the device of the invention.

This is the work phase illustrated in FIG. 1, in which the truck 11 mounting the cistern 12 with four separate compartments 13, 14, 15, 16, is schematically represented.

During the cleaning operation by means of the rotating head, the water containing the deposits is removed from the fuel storage tank 20 and conveyed into the compartment 14. From the compartment 14 the liquid is removed by means of a pump 21, is treated, filtered and conveyed to compartment 16, from which is it removed by a hydropump and sent back once more to the rotating head inside the fuel storage tank 20; following this procedure the liquid can be recuperated and recycled.

In this way the quantity of liquid effectively used is very limited.

In a fourth work phase the vehicle 10 is extracted from the tank; following this, steam coming from a boiler supplied with water contained in compartment 15 is fed into the fuel storage tank while at the same time the condensed water vapour is removed by aspiration.

This procedure serves to facilitate the chemical bond of the carbon in the hydrocarbons with the oxygen present in the steam.

The cleaning and degassing operation can thus be considered completed.

Figure 2:
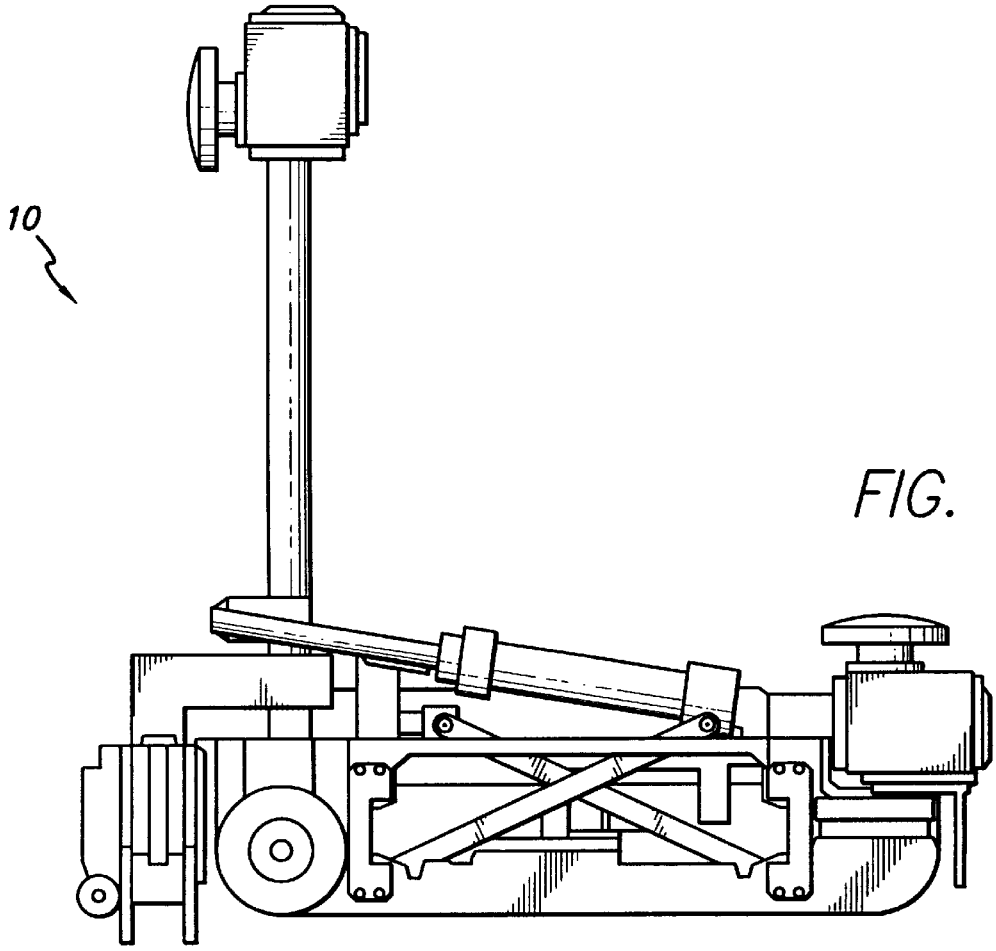
FIG. 2 is a lateral view of a motorised vehicle according to the invention.
Figure 3:
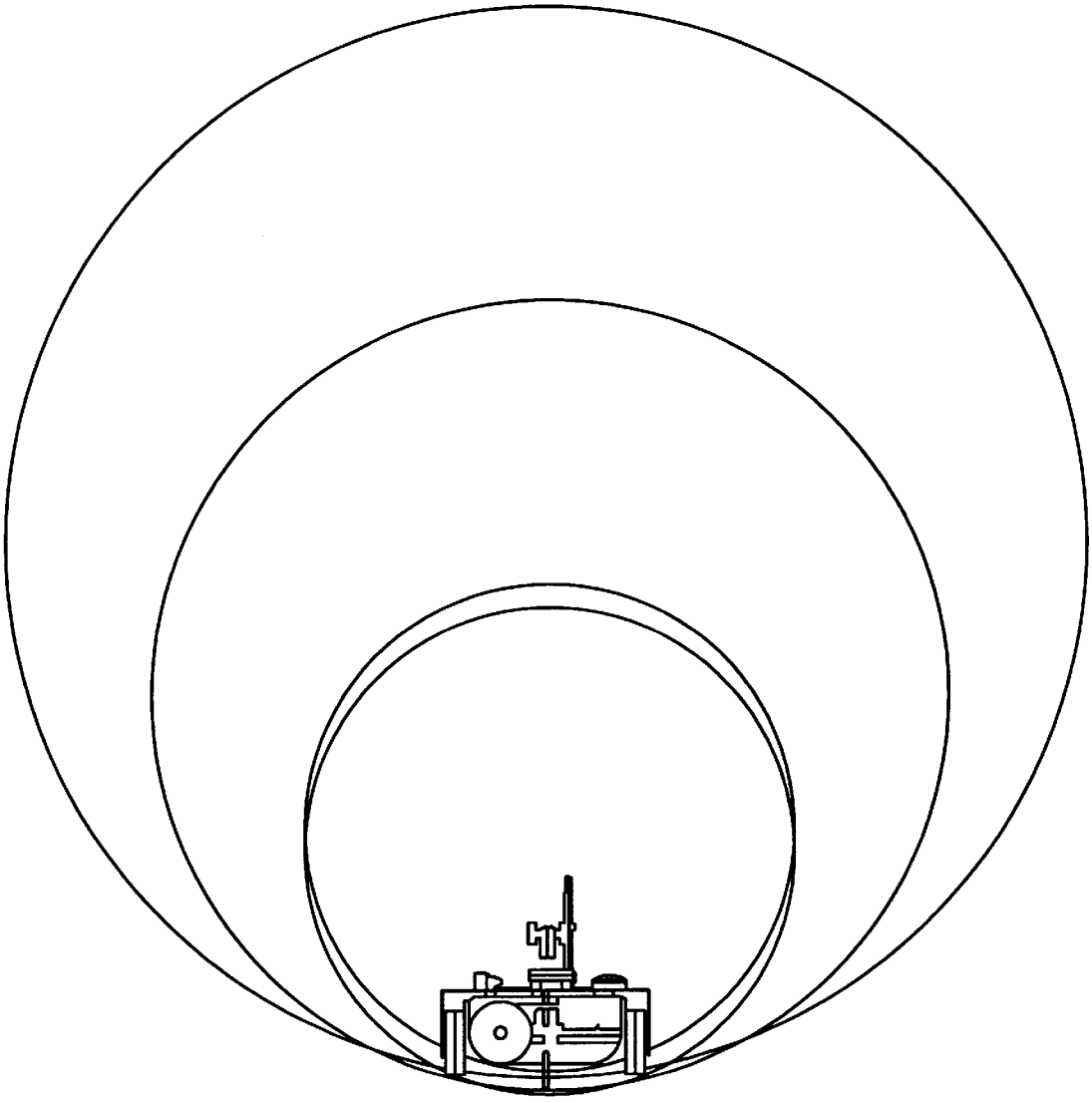
FIG. 3 is a frontal view of the vehicle of FIG. 2, with the vehicle inserted in a fuel storage tank to be cleaned and degassed.

The vehicle 10 illustrated in FIGS. 2 and 3 is provided with conical pulley pairs with elastic-material belts arranged both longitudinally and transversally.

Pneumatic or hydraulic controls activate the respective and separate engines for moving the vehicle in the various directions, as well as for raising and lowering the respective belt pairs.

The vehicle 10 is provided, as previously mentioned, with a series of frontal nozzles and a series of rotating nozzles for performing the above-described work phases, as well as with an elastically-suspended suction mouth which is thus able to adhere to the bottom of the fuel storage tank during the vehicle movements, so that it can remove the water which is then conveyed, according to the work phase, into various compartments of the cistern arranged on the support truck controlling the cleaning and degassing operation.

The reason for the differentiated conveying of the dirty water into the various compartments of the cistern is due to the fact that the water coming from the first cleaning phase, carried out By means of the frontal nozzles, is very polluted, while the water coming from the final washing operation, carried out by means of the rotating nozzles, is definitely re-usable after an appropriate reclaiming treatment.

The electronic control panel of the vehicle movements, achieved by means of pneumatic and/or hydraulic feeding systems, is subdivided into four main sections, of which the first is constituted by the axial movement control, the second by the raising system control for transversal movement, the third for transversal movement, and the fourth for the alternating movement of the rotating head during the cleaning operation.

The invention has been described making reference to a preferred embodiment thereof.

It is clear, however, that the invention is susceptible to numerous modifications of a technically-equivalent kind.

By way of example, the invention could have a further embodiment in which the vehicle is provided with a television camera and a light, so that a detailed check could be carried out from outside the fuel storage tank of the internal tank surfaces.

What is claimed is:

1. A device for cleaning and degassing underground tanks, comprising a motorised vehicle suitable for being inserted into and moved inside of a fuel storage tank to be cleaned and degassed, said vehicle being provided with a plurality of nozzles which emit a fluid, advantageously water, at a predetermined pressure and directed towards the internal surface of said tank, and with at least a suction mouth for collecting and expelling said water externally of said tank, the vehicle being at least one of pneumatically or hydraulically powered by means of motors which drive respective conical pulley pairs and longitudinal and transversal belt pairs.

2. A device according to claim 1, wherein the motorised vehicle comprises a first series of frontal nozzles which emit water towards a bottom of said tank.

3. A device according to claim 1, wherein a second series of nozzles is arranged on a rotating head connected to motorised vehicle, said second series of nozzles emitting a fluid, advantageously water, directed at high pressure against the side walls of said tank.

4. A device according to anyone of the preceding claims, wherein the vehicle is moved inside the storage tank by means of an external control panel.

5. A device according to anyone of claims 1, 2 or 3, wherein the motorised vehicle is connected to a support truck on which a cistern is mounted, said cistern being subdivided into a plurality of compartments for storing the cleaning water coming from the first washing phase, and for treating and re-using the cleaning water coming from the final washing operation carried out by the second series of nozzles.

6. A device according to anyone of claims 1, 2 or 3, wherein the vehicle is provided with a television camera connected to a television set situated externally of said fuel storage tank, as well as with a light for illuminating.

7. A device of any one of claims 1, 2 or 3 comprising means for effecting a first phase during which a filming substance is used internally of the fuel storage tank for forming on an internal surface there of a film, which film is proof to hydrocarbon vapours, means for effecting a second phase in which a flexible plastic pipe connected to a suction pump is introduced into the fuel storage tank through a manhole and immediately activated with the aim of aspirating a majority of muddy and sandy deposits present in a central part of a bottom of the tank, means for effecting a third phase during which the device is inserted into the fuel storage tank and is moved internally thereof during functioning of the suction mouth and the first series of frontal nozzles, and means for effecting a fourth phase during which said suction mouth is continuously operated while the first series of nozzles is deactivated and the second series of nozzles activated, which can be supplied with liquid, advantageously including at least one of water or with a filming agent.

8. A device according to claim 7, wherein means for effecting a fifth phase during which steam is introduced into said fuel storage tank and subsequently removed therefrom by aspiration.

9. A device according to claim 4, wherein the motorised vehicle is connected to a support truck on which a cistern is mounted, said cistern being subdivided into a plurality of compartments for storing the cleaning water coming from the first washing phase, and for treating and re-using the cleaning water coming from the final washing operation carried out by the second series of nozzles.

10. A device according to claim 4, wherein the vehicle is provided with a television camera connected to a television set situated externally of said fuel storage tank, as well as with a light for illuminating.

11. A device according to claim 5, wherein the vehicle is provided with a television camera connected to a television set situated externally of said fuel storage tank, as well as with a light for illuminating.

* * * * *